US006449770B1

(12) United States Patent
Taylor et al.

(10) Patent No.: US 6,449,770 B1
(45) Date of Patent: Sep. 17, 2002

(54) RESTRAINING GARMENT DEVICE

(76) Inventors: Nelly Taylor, 5318 Birch Bark Dr., Hoffman Estates, IL (US) 60192; Howard A. Taylor, 5318 Birch Bark Dr., Hoffman Estates, IL (US) 60192

( * ) Notice: Subject to any disclaimer, the term of this patent is extended or adjusted under 35 U.S.C. 154(b) by 0 days.

(21) Appl. No.: 10/003,324

(22) Filed: Nov. 2, 2001

(51) Int. Cl.[7] ..... A61B 19/00

(52) U.S. Cl. ..... 2/69; 128/869; 297/465

(58) Field of Search ..... 2/69, 69.5, 44, 2/45, 456, 460, 75, 114, 115, 93–96, 102, 108, 310, 80, 85, 326–333; 128/869, 874, 846, 875–877; 297/484, 485, 465, 483, 464, 482; 280/801.1, 803, 806, 808; 182/3–5; 244/151 R

(56) References Cited

U.S. PATENT DOCUMENTS

| | | | | | |
|---|---|---|---|---|---|
| 2,044,390 | A | | 6/1936 | Kiehs | |
| 2,375,655 | A | * | 5/1945 | Irvin | 2/84 |
| 3,788,309 | A | | 1/1974 | Zeilman | |
| 3,901,229 | A | * | 8/1975 | Hensel et al. | 128/873 |
| 4,132,230 | A | * | 1/1979 | Ladd | 128/874 |
| 4,437,628 | A | * | 3/1984 | Schwartz | 244/122 AE |
| D275,230 | S | | 8/1984 | Hubbard et al. | |
| 4,571,000 | A | * | 2/1986 | Holder | 128/874 |
| 4,832,053 | A | | 5/1989 | McCarthy | |
| 4,876,724 | A | * | 10/1989 | Suzuki | 2/250 |
| 5,161,258 | A | * | 11/1992 | Coltrain | 2/102 |
| 5,241,708 | A | | 9/1993 | Rodarmel | |
| 6,076,527 | A | | 6/2000 | Rottinghaus et al. | |

* cited by examiner

*Primary Examiner*—Gloria M. Hale
*Assistant Examiner*—Tejash Patel

(57) ABSTRACT

A restraining garment device for placing on a torso of a user. The device is for receiving a restraint belt of equipment such as strollers, highchairs, shopping carts, and car seats. The device includes a torso covering member that has a front panel portion and rear panel portion, neck aperture for receiving a head and neck of a user and a waist aperture for receiving a waist of a user. A pair of waist loop panels is mounted to and extends between the front and rear panel portions of the torso covering member defining a loop for selectively receiving a waist restraint belt. The device prevents a user from freeing themselves from the waist restraint belt.

16 Claims, 3 Drawing Sheets

RESTRAINING GARMENT DEVICE

BACKGROUND OF THE INVENTION

1. Field of the Invention

The present invention relates to safety clothing and more particularly pertains to a new restraining garment device for placing on a torso of a user for receiving a restraint belt of equipment such as strollers, highchairs, shopping carts, and car seats. The restraining garment device prevents a user from freeing themselves from the restraining belt.

2. Description of the Prior Art

The use of safety clothing is known in the prior art. More specifically, safety clothing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,832,053; U.S. Pat. No. 5,241,708; U.S. Pat. No. 6,076,527; U.S. Pat. No. 3,788,309; U.S. Pat. No. 2,044,390; and U.S. Pat. No. Des. 275,230.

While these devices fulfill their respective, particular objectives and requirements, the aforementioned patents do not disclose a new restraining garment device. The inventive device includes a torso covering member that has a front panel portion and rear panel portion, neck aperture for receiving a head and neck of a user and a waist aperture for receiving a waist of a user. A pair of waist loop panels is mounted to and extends between the front and rear panel portions of the torso covering member defining a loop for selectively receiving a waist restraint belt, thereby preventing a user from freeing themselves from the waist restraint belt.

In these respects, the restraining garment device according to the present invention substantially departs from the conventional concepts and designs of the prior art, and in so doing provides an apparatus primarily developed for the purpose of placing on a torso of a user for receiving a restraint belt of equipment such as strollers, highchairs, shopping carts, and car seats.

SUMMARY OF THE INVENTION

In view of the foregoing disadvantages inherent in the known types of safety clothing now present in the prior art, the present invention provides a new restraining garment device construction wherein the same can be utilized for placing on a torso of a user for receiving a restraint belt of equipment such as strollers, highchairs, shopping carts, and car seats.

The general purpose of the present invention, which will be described subsequently in greater detail, is to provide a new restraining garment device apparatus and method which has many of the advantages of the safety clothing mentioned heretofore and many novel features that result in a new restraining garment device which is not anticipated, rendered obvious, suggested, or even implied by any of the prior art safety clothing, either alone or in any combination thereof.

To attain this, the present invention generally comprises a torso covering member that has a front panel portion and rear panel portion, a neck aperture for receiving a head and neck of a user and a waist aperture for receiving a waist of a user. A pair of waist loop panels is mounted to and extends between the front and rear panel portions of the torso covering member defining a loop for selectively receiving a waist restraint belt, thereby preventing a user from freeing themselves from the waist restraint belt.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new restraining garment device apparatus and method which has many of the advantages of the safety clothing mentioned heretofore and many novel features that result in a new restraining garment device which is not anticipated, rendered obvious, suggested, or even implied by any of the prior art safety clothing, either alone or in any combination thereof.

It is another object of the present invention to provide a new restraining garment device which may be easily and efficiently manufactured and marketed.

It is a further object of the present invention to provide a new restraining garment device which is of a durable and reliable construction.

An even further object of the present invention is to provide a new restraining garment device which is susceptible of a low cost of manufacture with regard to both materials and labor, and which accordingly is then susceptible of low prices of sale to the consuming public, thereby making such restraining garment device economically available to the buying public.

Still yet another object of the present invention is to provide a new restraining garment device which provides in the apparatuses and methods of the prior art some of the advantages thereof, while simultaneously overcoming some of the disadvantages normally associated therewith.

Still another object of the present invention is to provide a new restraining garment device for placing on a torso of a user for receiving a restraint belt of equipment such as strollers, highchairs, shopping carts, and car seats.

Yet another object of the present invention is to provide a new restraining garment device which includes a torso covering member that has a front panel portion and rear panel portion, neck aperture for receiving a head and neck of a user and a waist aperture for receiving a waist of a user. A pair of waist loop panels is mounted to and extends between the front and rear panel portions of the torso covering member defining a loop for selectively receiving a waist restraint belt, thereby preventing a user from freeing themselves from the waist restraint belt.

Still yet another object of the present invention is to provide a new restraining garment device that prevents children and other users from being injured from falling out of a high chair, shopping cart, car seat or stroller.

Even still another object of the present invention is to provide a new restraining garment device that may be colorful with designs and pictures which makes it more fun as everyday wear and less of a hassle for children to use than conventional types of restraining garments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
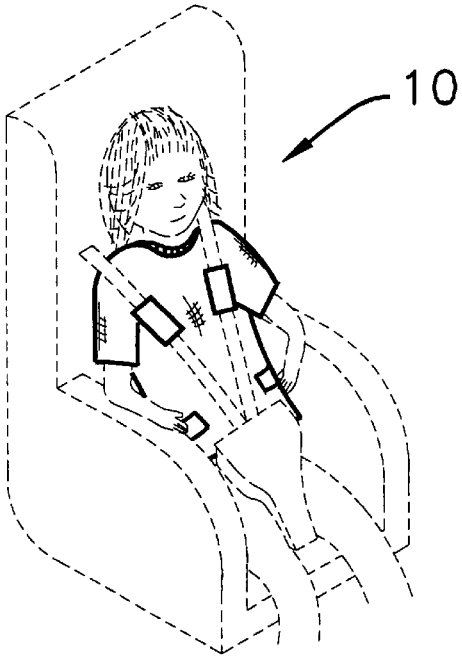
FIG. 1 is a schematic perspective view of a new restraining garment device according to the present invention.

With reference now to the drawings, and in particular to FIGS. 1 through 5 thereof, a new restraining garment device embodying the principles and concepts of the present invention and generally designated by the reference numeral 10 will be described.

As best illustrated in FIGS. 1 through 5, the restraining garment device 10 generally comprises a torso covering member 12 that has front 13 and rear 14 panel portions. The torso covering member 12 has a waist aperture 15 for selectively receiving a head and neck of a user putting the torso covering member 12 onto their body. The torso covering member 12 also has a waist aperture 16 for selectively receiving a waist of a user. The neck 15 and waist 16 apertures are generally opposed to and in registration with each other. The torso covering member 12 may have a longitudinal axis extending through the neck 15 and waist 16 apertures.

The torso covering member 12 may comprise a shirt, a sweater, a vest, or a jacket. Any type of torso covering member may be employed. Additionally, pockets may be mounted to the front 13 and rear 14 panel portions for storage.

A pair of sleeve panel portions 18 may be mounted to the torso covering member 12 and may be positioned generally adjacent to the neck aperture 15. Each of the sleeve panel portions 18 has an arm aperture 19 for receiving an arm of a user. The sleeve panel portions 18 may be short sleeve panel portions such that they cover only a portion of a user's arm or they may be long sleeve panel portions such that the cover substantially all of the user's arm.

In one embodiment of the present invention, the torso covering member 12 may comprise generally flexible material such as, for example, a cotton, vinyl or leather material. Other materials may also be employed in the manufacture of the torso covering member 12.

A pair of waist loop panels 20 is mounted to the torso covering member 12 for selectively receiving a restraint belt such as those used in car seats, high chairs, strollers and shopping carts. In one embodiment of the present invention, each of the waist loop panels 20 has a pair of opposed longitudinal edges 21 and a pair of end edges 22. Each of the longitudinal edges 21 is mounted to the torso covering member 12 either by sewing or some type of releasable fastening means such as, for example, a hook and loop fastener or a snap assembly. Each of the end edges defines access openings 23 for selectively receiving a waist restraint belt.

Figure 3:
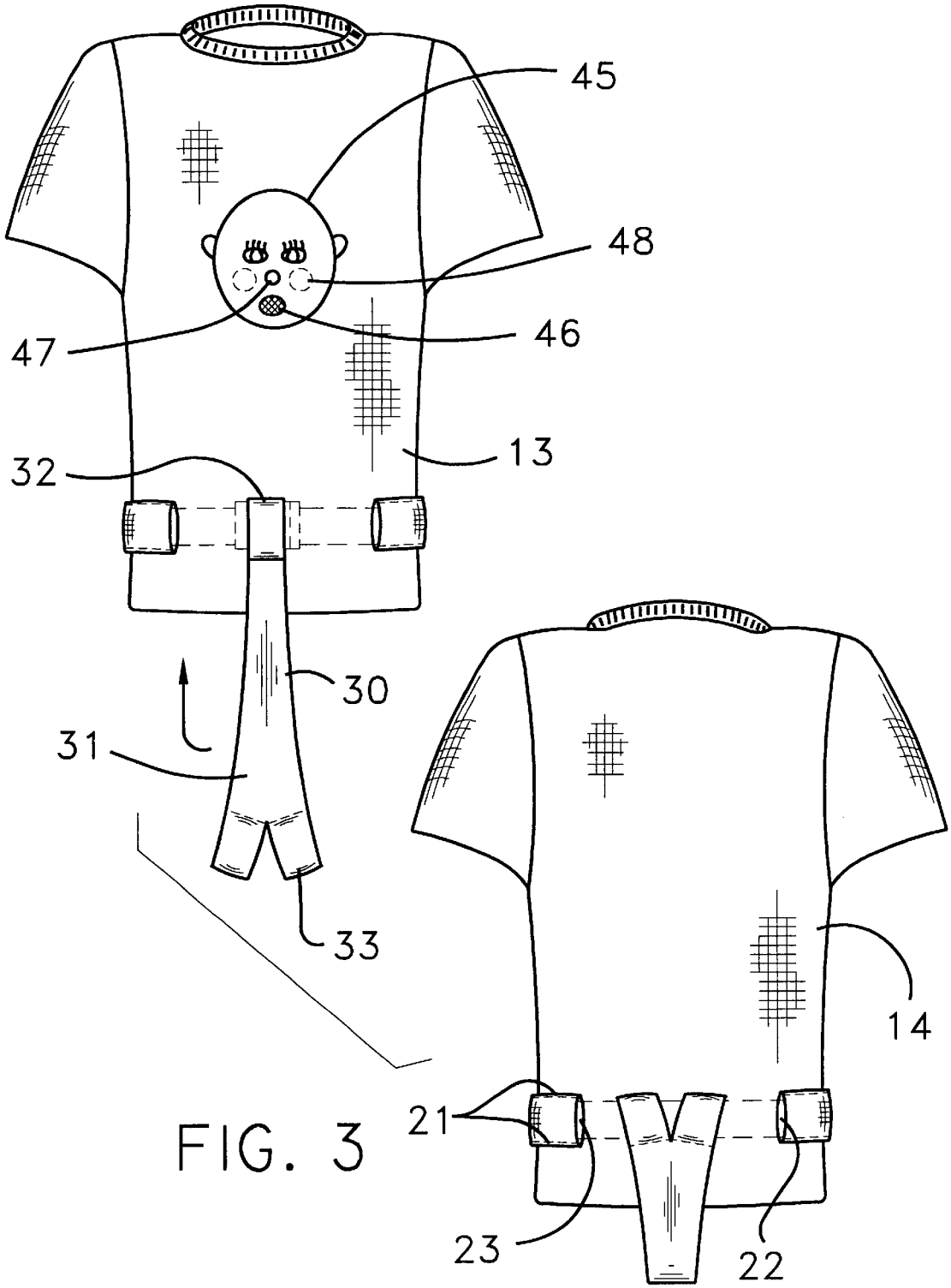
FIG. 3 is a schematic frontal and rear view of the present invention.

In one embodiment of the present invention, as illustrated in FIG. 3, each of the waist loop panels 20 extends between the front 13 and rear 14 panel portions of the torso covering member 12 such that the access openings 23 of each of the waist loop panels 20 are in registration with each other. As illustrated in FIG. 3, each of the waist loop panels 20 is preferably positioned about the torso covering member 12 such that the restraint belt extends through both of the waist loop panels 20 and is releaseably coupled together in front of the front panel portion 13 of the torso covering member 12.

In one embodiment of the present invention, each of the waist loop panels 20 may comprise a substantially flexible material such as, for example, a cloth, vinyl or leather material. However, other types of materials may also be employed.

The torso covering member 12 may also include a pair of shoulder loop panels 24 that are mounted to the front panel portion 13 of the torso covering member 12 for selectively receiving a shoulder restraint belt. In one embodiment of the present invention, each of the shoulder loop panels 24 has a pair of opposed longitudinal edges 25 and a pair of end edges 26. Each of the longitudinal edges 25 of each of the shoulder loop panels 24 is mounted to the torso covering member 12. Each of the end edges 26 of the shoulder loop panels 24 defines access openings 27 for selectively receiving a shoulder restraint belt.

Figure 2:
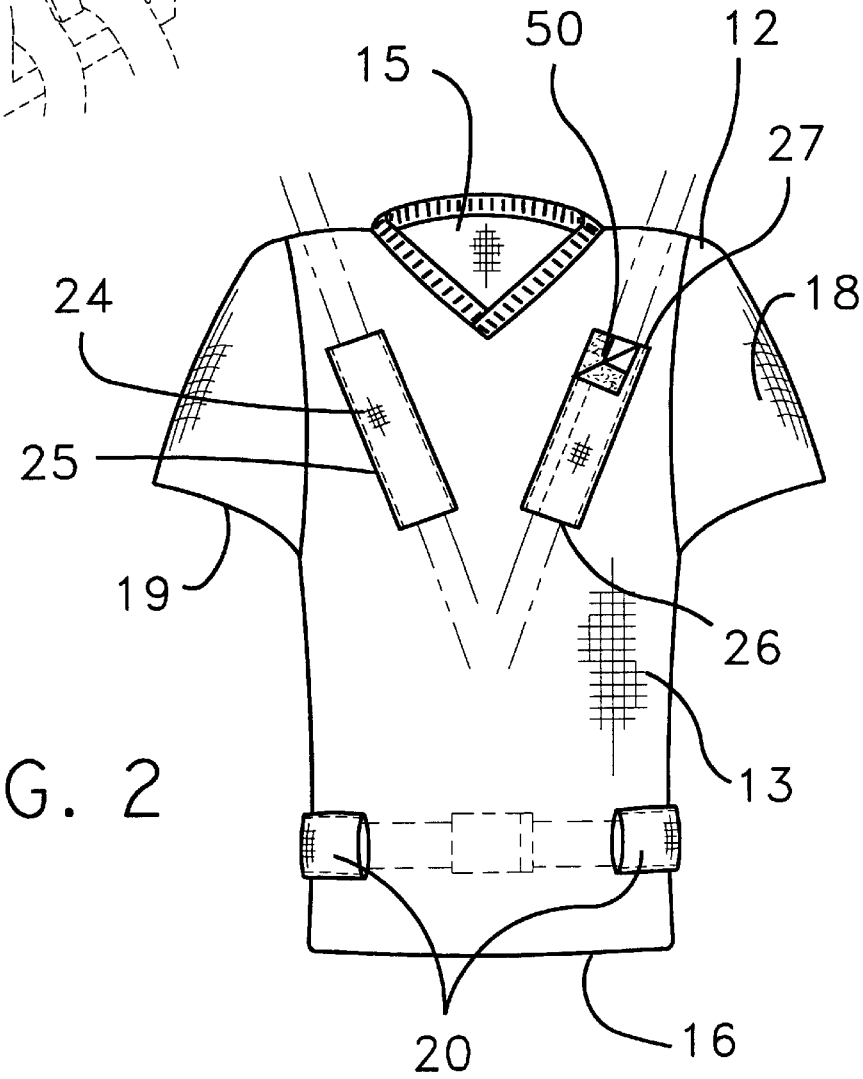
FIG. 2 is a schematic frontal view of the present invention.

As illustrated in FIG. 2, a fastening means 50 may be mounted to the front panel portion 13 and an inner surface of the shoulder loop panel 24 for releaseably fastening the shoulder loop panel 24 to the front panel portion 13 of the torso covering member 12. The fastening means 50 permits a user to place a shoulder restraint belt that cannot be threaded through the shoulder loop panel 24 between the shoulder loop panel 24 and the front panel portion 13 of the torso covering member 12. The fastening means 50 may comprise a hook and loop fastener or any other type of fastening means.

In one embodiment of the present invention, each of the shoulder loop panels 24 is positioned generally adjacent to the neck aperture 15. The pair of longitudinal edges 25 of each of the shoulder loop panels 24 may extend generally between the arm panels 18 and the waist aperture 16, whereby a longitudinal axis of each of the shoulder loop panels 24 intersects each other. As illustrated in FIG. 2, each of the shoulder loop panels 24 may be positioned in a generally V-orientation on the front panel portion 13 of the torso covering member 12.

A securing means 30 may be provided for securing a user in the torso covering member 12 and thereby securing the user to the restraint belts. The securing means prevents a user, such as a child, from escaping from the torso covering member 12 by dropping out of the waist aperture 16 of the torso covering member 12. As generally illustrated in FIG. 3, the securing means 30 may be couplable to and may extend between a rear portion and a front portion of a restraint belt. In one embodiment of the present invention, the securing means 30 is positioned generally between a user's legs, thereby preventing a user from escaping through the waist aperture 16 of the torso covering member 12.

In one embodiment of the present invention, the securing means 30 may comprise a strap 31 that has a first looped end 32 and a pair of second looped ends 33. The restraint strap is removably extendable through the looped ends 32 and 33 of the strap 31. Additionally, a portion of the first looped end 32 of the strap 31 may be positioned over a fastening assembly of the restraint belt, thereby preventing a user from unfastening the restraint belt.

In one embodiment of the present invention, as particularly illustrated in FIG. 3, a width of the strap 31 may taper from the pair of second looped ends 33 toward the first looped end 32 of the strap 31. The securing means 30 may comprise a substantially flexible material such as, for example, a cotton, vinyl, or leather material.

Figure 4:
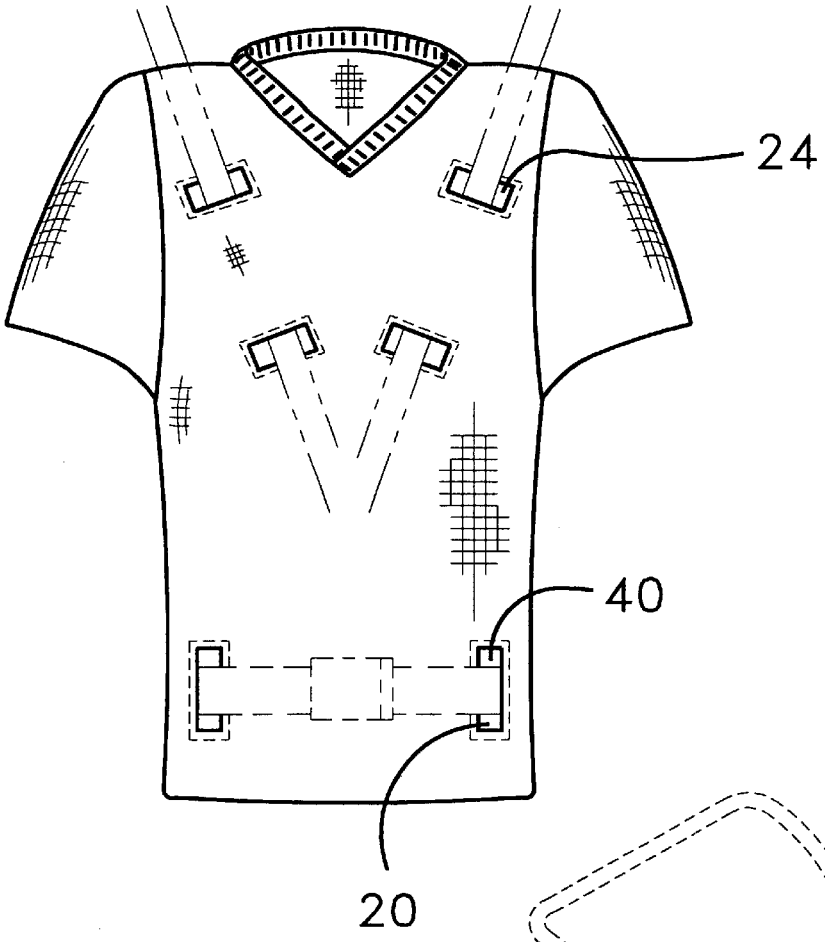
FIG. 4 is a schematic frontal view of an alternate embodiment of the present invention.
Figure 5:
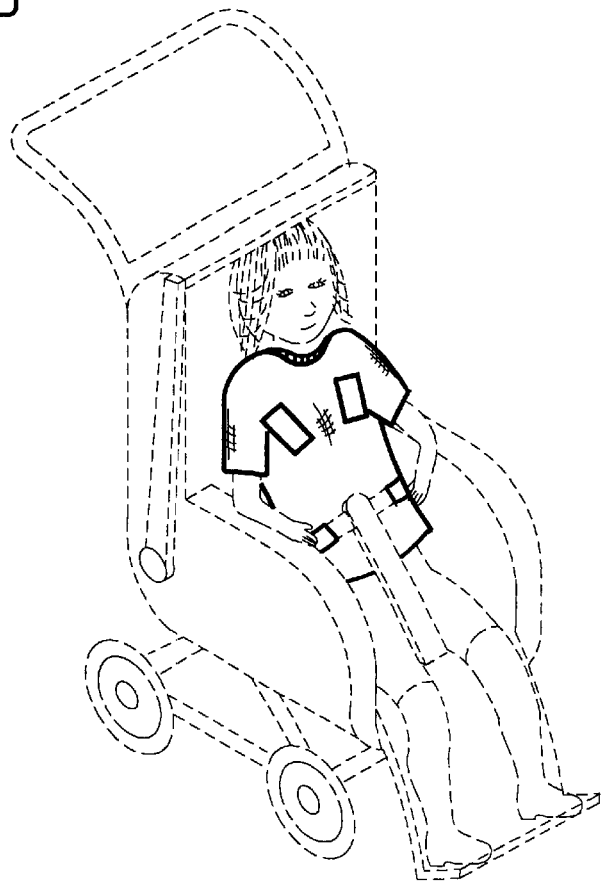
FIG. 5 is a schematic perspective view of the present invention.

In an alternate embodiment of the present invention, as particularly illustrated in FIG. 4, the front 13 and rear 14 panel portions of the torso covering member 12 has a plurality of spaced access openings 40 that extend through the front 13 and rear 14 panel portions of the torso covering member 12 for selectively receiving the restraint belts. As illustrated in FIG. 5, at least one pair of the spaced access openings 40 extend through the front 13 and rear 14 panel portions and may be positioned generally adjacent to the waist aperture 16 of the torso covering member 12. The waist loop panel 20 may be mounted to an inner surface of the front 13 and rear 14 panel portions of the torso covering member 12 for preventing the waist restraint belt from rubbing against a user's skin.

A pair of the spaced access openings 40 for the alternate embodiment may extend through the front 13 panel portion of the torso covering member 12 for receiving a shoulder restraint belt. The shoulder loop panel 24 may be mounted to the inner surface of the front panel portion 13 of the torso covering member 12 for preventing the shoulder restraint belt from rubbing against a user's skin. The shoulder loop panel 24 preferably extends between the pair of spaced access opening 40.

The torso covering member 12 may employ a speaker assembly 45 for emitting a slogan such as, for example, "are you buckled in." The speaker assembly 45 may also emit other types of slogans. The speaker assembly 45 may comprise a speaker 46 for emitting the slogan, a power supply 47 for selectively providing power to the speaker 46 and an actuating means 48 for activating the speaker 46 to emit the slogan. The speaker assembly 45 may be mounted to the front panel portion 13 of the torso covering member 12 for being activated by a user and may include designs such as for example, faces, balloons and flowers.

In use, an individual such as a caregiver places the user in the torso covering member 12. Once the user is in the torso covering member 12, the user may be placed in a device having waist and/or shoulder restraint belts. The individual placing the user in the device may then thread the waist restraint belt through the waist loop panels 20 and may thread the shoulder restraint belt through the shoulder loop panels 24.

To prevent the user from falling out of the device by escaping through the waist aperture 16 of the torso covering member 12, the securing means 30 may be coupled to the waist restraint belt and extended between the users legs. The only way to be released from the restraining garment device 10 is for the individual to remove the waist and shoulder restraint belt and the securing means 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A restraining garment device for placing on a torso of a user for receiving a restraint belt of equipment such as strollers, highchairs, shopping carts, and car seats, said restraining garment device comprising:

a torso covering member having a front panel portion and rear panel portion, a neck aperture for receiving a head and neck of a user and a waist aperture for receiving a waist of a user;

a pair of waist loop panels being mounted to and extending between said front and rear panel portions of said torso covering member, each of said waist loop panels defining a loop for selectively receiving a waist restraint belt for impeding a user from freeing himself from the waist restraint belt without removing said torso covering member;

a securing means for securing a user in said torso covering member, said securing means being couplable to a rear portion and a front portion of a restraint belt, wherein said securing means is positionable generally between a user's legs; and wherein said securing means comprises a strap having a first looped end and at least one second looped end, wherein the restraint strap is removably extendable through said looped ends of said strap.

2. The restraining garment device of claim 1, additionally including at least one shoulder loop panel being mounted to said front panel portion of said torso covering member for selectively receiving a shoulder restraint belt.

3. The restraining garment device of claim 2, wherein said at least one shoulder loop panel has a pair of longitudinal edges and a pair of end edges, each of said longitudinal edges being mounted to said torso covering member, each of said end edges defining access openings for selectively receiving the restraint belt.

4. The restraining garment device of claim 1, wherein said torso covering member comprises generally flexible material.

5. The restraining garment device of claim 1, wherein each of said waist loop panels has a pair of opposite longitudinal edges and a pair of end edges, each of said longitudinal edges being mounted to said torso covering member, each of said end edges defining access openings for selectively receiving the restraint belt.

6. The restraining garment device of claim 5, wherein each of said waist loop panels has a longitudinal axis extending substantially parallel to an edge of said torso covering member defining said waist opening.

7. The restraining garment device of claim 1, wherein said at least one second loop ends comprises a pair of second looped ends spaced generally apart from each other such that the restraint strap is removably extendable through said pair of second looped ends.

8. The restraining garment device of claim 1, wherein a width of said strap tapers from said at least one second looped end toward said first looped end of said strap.

9. The restraining garment device of claim 1, additionally including a speaker assembly for emitting a slogan, said speaker assembly being mounted to said front panel portion of said torso covering member.

10. The restraining garment device of claim 9, wherein said speaker assembly includes:

a speaker for emitting the slogan;

a power supply for selectively providing power to said speaker; and an actuating means being depressibly mounted to said speaker assembly for activating said speaker to emit the slogan.

11. A restraining garment device for placing on a torso of a user for receiving a restraint belt of equipment such as strollers, highchairs, shopping carts, and car seats, said restraining garment device comprising:

a torso covering member having front and rear panel portions, said torso covering member having a waist aperture for selectively receiving a head and neck of a user, said torso covering member having a waist aperture for selectively receiving a waist of a user, said neck and waist apertures being generally opposed to and in registration with each other, said torso covering member having a longitudinal axis extending through said neck and waist apertures;

a pair of sleeve panel portions being mounted to said torso covering member and positioned generally adjacent to said neck aperture, each of said sleeve panel portions having an arm aperture for receiving an arm of a user;

wherein said torso covering member comprises generally flexible material;

a pair of waist loop panels being mounted to said torso covering member for selectively receiving a restraint belt, wherein each of said waist loop panels has a pair of opposite longitudinal edges and a pair of end edges, each of said longitudinal edges being mounted to said torso covering member, each of said end edges defining access openings for selectively receiving waist restraint belt;

wherein each of said waist loop panels extends between said front and rear panel portions of said torso covering member;

wherein each of said waist loop panels has a longitudinal axis extending substantially parallel to an edge of said torso covering member defining said waist opening;

wherein each of said loop panels comprises a substantially flexible material;

a pair of shoulder loop panels being mounted to said front panel portion of said torso covering member for selectively receiving a restraint belt, wherein each of said shoulder loop panels has a pair of longitudinal edges and a pair of end edges, each of said longitudinal edges of each of said shoulder loop panels being mounted to said torso covering member, each of said end edges defining access openings for selectively receiving a shoulder restraint belt;

wherein each of said shoulder loop panels is positioned generally adjacent to said neck aperture, said pair of longitudinal edges of each of said shoulder loop panels extending generally between said arm panels and said waist aperture, a longitudinal axis of each of said shoulder loop panels intersecting each other;

a fastening means mounted to said front panel portion and to an inner surface of said shoulder loop panels for releasably fastening said shoulder loop panels to said front panel portion of said torso covering member, said fastening means permitting user to place a shoulder restraint belt that cannot be threaded through said shoulder loop panels between said shoulder loop panels and said front panel portion of said torso covering member;

wherein said fastening means comprises a hook and loop fastener;

a securing means for securing a user in said torso covering member, said securing means being couplable to and extending between a rear portion and a front portion of a restraint belt, wherein said securing means is positionable generally between a user's legs;

wherein said securing means comprises a strap having a first looped end and a pair of second looped ends, wherein the restraint strap is removably extendable through said looped ends of said strap; and wherein a width of said strap tapers from said pair of second looped ends toward said first looped end of said strap.

12. A restraining garment device for placing on a torso of a user for receiving a restraint belt of equipment such as strollers, highchairs, shopping carts, and car seats, said restraining garment device comprising:

a torso covering member having a front panel portion and rear panel portion, a neck aperture for receiving a head and neck of a user and a waist aperture for receiving a waist of a user, said front and rear panel portions having an outer surface and an inner surface;

wherein said front and rear panel portions of said torso covering member has at least a pair of spaced access openings extending there through;

a pair of waist loop panels being mounted to said inner surface of said front panel portion and extending between said pair of spaced access openings defining a loop for selectively receiving a waist restraint belt;

a securing means for securing a user in said torso covering member, said securing means being couplable to a rear portion and a front portion of a restraint belt, wherein said securing means is positionable generally between a users legs; and wherein said securing means comprises a strap having a first looped end and at least one second looped end, wherein the restraint strap is removably extendable through said looped ends of said strap.

13. The restraining garment device of claim 12, additionally including plurality of spaced access openings extending through said front panel portion of said covering member; and a plurality of shoulder loop panels being mounted to said inner surface of said front panel portion of said torso covering member and extending between said access openings for selectively receiving a shoulder restraint belt.

14. The restraining garment device of claim 12, wherein said torso covering member comprises generally flexible material.

15. The restraining garment device of claim 12, wherein said at least one second loop end comprises a pair of second looped ends spaced generally apart from each other, wherein the restraint strap is removably extendable through said pair of second looped ends.

16. The restraining garment device of claim 12, wherein a width of said strap tapers from said pair of second looped ends toward said first looped end of said strap.

* * * * *